US006978999B2

(12) United States Patent
Kline et al.

(10) Patent No.: US 6,978,999 B2
(45) **Date of Patent: *Dec. 27, 2005**

(54) THERAPEUTIC ROLE-PLAYING BOARD GAME

(76) Inventors: Beverly Kline, R.R. 1, P.O. Box 157, Beaver Springs, PA (US) 17812; Emilie Ward, 530 E. 20th St., Apt. 1A, New York, NY (US) 10009

( * ) Notice: Subject to any disclaimer, the term of this patent is extended or adjusted under 35 U.S.C. 154(b) by 0 days.

This patent is subject to a terminal disclaimer.

(21) Appl. No.: 10/746,469

(22) Filed: Dec. 24, 2003

(65) Prior Publication Data

US 2004/0178577 A1 Sep. 16, 2004

Related U.S. Application Data

(63) Continuation of application No. 09/241,678, filed on Feb. 2, 1999, now Pat. No. 6,685,187.

(51) Int. Cl.[7] ..... A63F 3/00

(52) U.S. Cl. ..... 273/236; 273/243

(58) Field of Search ..... 273/236, 243

(56) References Cited

U.S. PATENT DOCUMENTS

| | | | | |
|---|---|---|---|---|
| 2,128,749 | A | 8/1938 | Koch et al. | |
| 3,942,799 | A | 3/1976 | Cory | |
| 4,273,337 | A * | 6/1981 | Carrera et al. | 273/243 |
| 4,932,667 | A * | 6/1990 | Gorski et al. | 273/249 |
| 4,991,854 | A | 2/1991 | Weiss | |
| 5,062,645 | A | 11/1991 | Goodman et al. | |
| 5,071,134 | A | 12/1991 | Burroughs, Jr. | |
| 6,279,908 | B1 * | 8/2001 | Hunsberger | 273/249 |
| 6,685,187 | B1 * | 2/2004 | Kline et al. | 273/243 |

FOREIGN PATENT DOCUMENTS

| | | |
|---|---|---|
| CH | 642 859 | 6/1981 |
| DE | 680380 | 2/1938 |
| JP | 0029326 | 3/1997 |

* cited by examiner

*Primary Examiner*—Vishu K. Mendiratta
(74) *Attorney, Agent, or Firm*—St. Onge Steward Johnston & Reens LLC

(57) ABSTRACT

A game apparatus and method for playing a game is disclosed. The game includes a board and a first set of cards bearing indicia of a situation to be enacted by the players and a second set of cards bearing indicia of at least one of a role, style or feeling for the situation to be enacted by the players. The game includes moving a player piece along a path of movement on the game board.

2 Claims, 5 Drawing Sheets

THERAPEUTIC ROLE-PLAYING BOARD GAME

This application is a continuation of U.S. patent application Ser. No. 09/241,678, filed Feb. 2, 1999, now U.S. Pat. No. 6,685,187.

FIELD OF THE INVENTION

A board game for therapeutic and recreational purposes, specifically, a board game with game pieces that are moved along a path of squares in response to the roll of dice and wherein players draw one or more of a plurality of different playing cards and then enact or improvise a situation based on the one or more cards drawn.

BACKGROUND OF THE INVENTION

Robert Landy's role therapy method promotes the concept that "as role takers and role players, people become a cast of characters unto themselves and stumble toward ways to live among the contradictory pulls of their personae." (Landy, 1994) Landy's role therapy method involves a number of treatment steps, including invoking, naming and exploring a role, and developing both function and alternative qualities in the form of sub-roles through puppet and mask work in an extended dramatization. This process incorporates role reflection whereby clients reflect upon quality and function of roles and relate the fictional roles to their everyday life. The distance of the role affords clients the safety to play out issues through these fictional roles. Improvised enactments, as well as projective techniques, offer clients the space to explore and move through roles; new roles can be recognized and previously denied roles acknowledged.

Landy's method provides the means to understand role in a system of organization or taxonomy. His taxonomy is a classification system of the recurring roles throughout the history of western dramatic literature. This taxonomy is a systematic arrangement of role type according to function, quality and style presentation. (Landy, 1994)

According to Landy: "Clients who are able to invoke and name roles, to play them out and reflect upon them as parts of themselves, would be well within the normal range of functioning. Any significant deviation from this would indicate a truncated role system" (Landy, 1994).

Applicants offer an assessment instrument and treatment tool in the form of their enactment board game, ROLE THE DICE. ROLE THE DICE seeks to access a client's (or player's) current internal role repertoire evidenced by a series of spontaneous role play enactments, specified by role type, quality, and style presentation, and substantiated by self-reported reflection. Applicants employ improvisation as a projective means to give rise to one's role system and view the realm of play to be the ideal non-threatening place where creativity and exploration are honored. In this locale, ROLE THE DICE weds game playing with spontaneous improvisation to facilitate the exploration of role. The therapeutic goals of ROLE THE DICE are both intra- and interpersonal. As a therapeutic treatment tool, ROLE THE DICE desires to enhance communication and increases socialization among group members.

OBJECTS OF THE INVENTION

It is an object of the present invention to provide for a game apparatus and unique method of playing the game apparatus which can impart therapeutic results and cohesiveness in a group of players (or clients).

It is a further object of the present invention to provide a unique game board having a perimeter portion including a number of boxes or squares across which the players may move, which boxes or squares have indicia thereon. This indicia provides information from which the players will be directed to draw one or more cards providing a situation for improvisation.

It is a further object of the present invention to provide a unique set of enactment cards for providing and describing a situation that calls for improvisation.

It is a further object of the present invention to provide indicia on the boxes or squares on the perimeter of the game board for providing other information including indicating which color enactment card to draw and/or indicating a particular action for the player to take and/or indicating which one or more additional cards to draw for providing an added dimension(s) to the situation that calls for improvisation.

It is a further object of the present invention to provide a unique spinner having areas corresponding to actions to be taken by the player (or client), including actions requiring the player to draw from different types of card sets which provide an added dimension(s) to the situation that calls for improvisation.

These and other objects are further provided for in a unique method of playing the game apparatus, the unique method comprising the steps of: determining an order of play for the number of players; each player placing, in order of play, the player's piece at a start box or square on the game board; each player moving, in response to the operation of the first random selection means, through the boxes or squares of the game board to a landing box or square; each player responding to instructions, if any, on the landing box or square, until proceeding to a landing box or square which requires drawing at least an enactment card; drawing an enactment card corresponding to the particular indicated color of the landing box or square; based on the indicia on the particular colored landing box or square, if any, drawing one or more additional cards and/or operating a second means for selecting an action to be taken by the player; enacting the situation described on the enactment card based on added dimension(s), if any, provided by any one or more additional cards drawn.

SUMMARY OF THE INVENTION

These objects and others are provided for in a game apparatus comprising: a first set of cards, each card of the first set of cards (enactment cards) bearing a situation that calls for an improvisation; a second set of cards, each card of the second set of cards bearing a role (villain, mother, lawyer, etc.) for the player (or client) to enact the situation in the role drawn; a third set of cards, each card of the third set of cards bearing a style or genre (musical comedy, soap opera, etc.) for the player (or client) to enact the situation in the style drawn; a fourth set of cards, each card of the fourth set of cards bearing a feeling (love, hate, etc.) for the player (or client) to enact the situation in the feeling drawn; a game board having a perimeter portion having a plurality of adjacently positioned colored (or having indicia of a particular color) boxes or squares bearing indicia, at least some of the boxes having indicia identifying one or more of the role, style, and feeling cards and at least some other boxes having indicia requiring moving player pieces or spinning a spinner; a first means to randomly select a number from a finite set of numbers (e.g., dice), which means is operable by each of the players (or clients); a plurality of player pieces for placement on and movement through the plurality of boxes on the perimeter portion of the game board; a second means to randomly select from a number actions to be taken by the player (or client) from a finite set of numbers, which means is operable by each of the clients; wherein players commence and maintain play by moving player pieces around the perimeter of the game board in response to random numbers obtained by the player operating the random selection means and wherein the players are challenged to enact the situations read from the enactment cards along with one or more of the role, style and feeling cards, if any, wherein the enactment card is chosen based on the indicated color of the particular box or square landed on and the role, style, and feeling cards are chosen based on the indicia of the particular box or square and/or by the second means to randomly select an action to be taken by the player (or client).

This and other objects are further provided for in a unique method of playing the game apparatus, the unique method comprising the steps of: determining an order of play for the number of players; each player placing, in order of play, the player's piece at a start box or square on the game board; each player moving, in response to the operation of the first random selection means, through the colored boxes or squares of the game board to a landing box or square; each player responding to instructions, if any, on the landing box or square, until proceeding to a landing box or square which requires drawing at least an enactment card; drawing an enactment card corresponding to the particular indicated color of the landing box or square; based on the indicia on the particular colored landing box or square, if any, drawing one or more additional cards and/or operating the second means for selecting a random number; enacting the situation on the enactment card based on added dimension(s), if any, provided by any one or more additional cards drawn.

DETAILED DESCRIPTION OF THE PREFERRED EMBODIMENT

Figure 1:
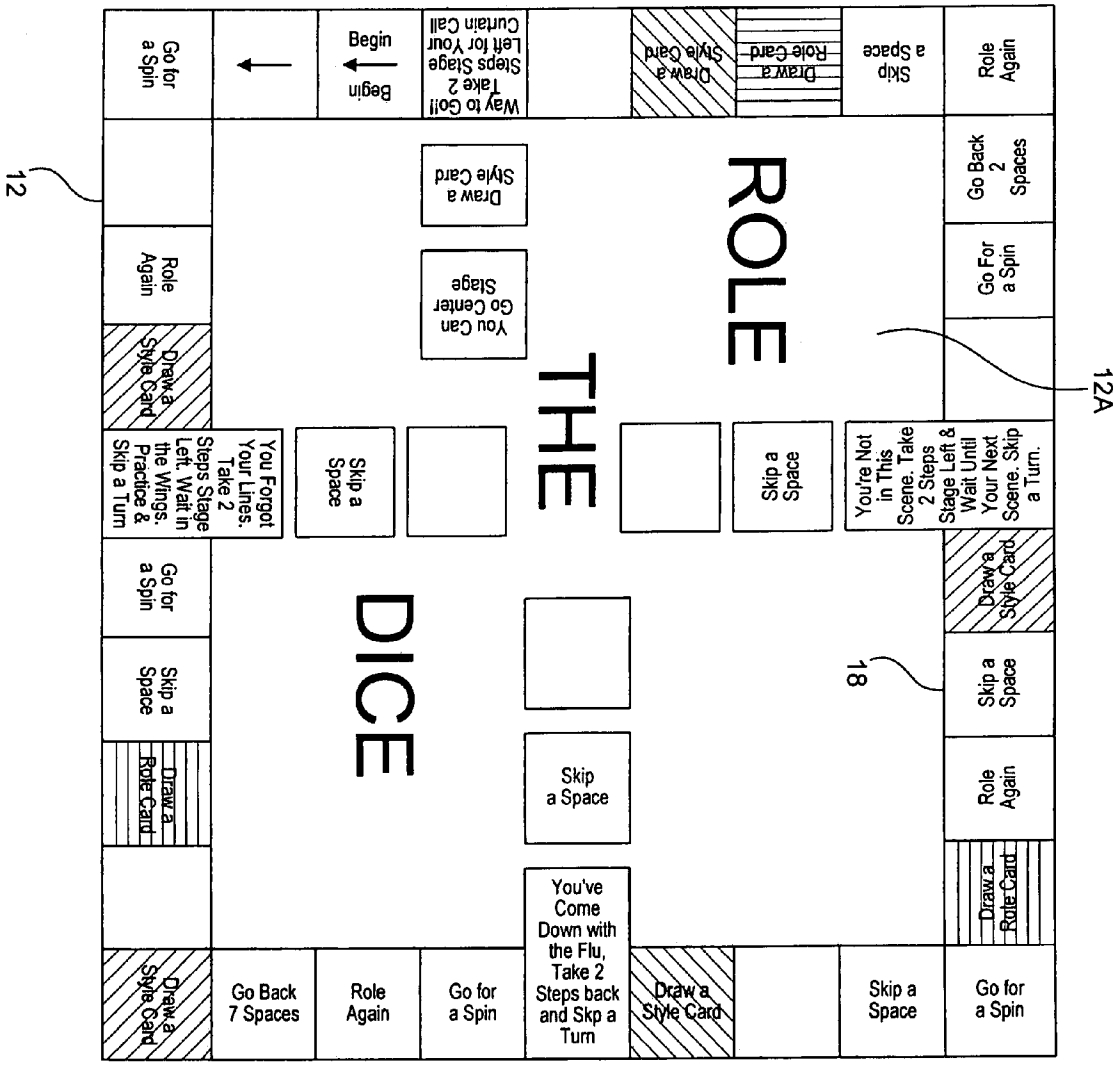
FIG. 1 is a front elevational view of a game board of the preferred embodiment of applicants' game apparatus.

FIGS. 1–10 illustrate the elements of applicant's unique game apparatus. More specifically, FIG. 1 illustrates a game board (12), typically a foldable square and comprised of stiff cardboard and having a top surface **(12*a*) thereon. The top surface is seen to have around the border of the game board (12) a perimeter area (16), the perimeter area being comprised of a plurality of adjacently located rectangular, spaced apart, perimeter boxes (18) include a Green Room box (18*a*)** where play is commenced. The boxes have one or more indicia thereon relating to playing the game as set forth more fully below.

Figure 2:
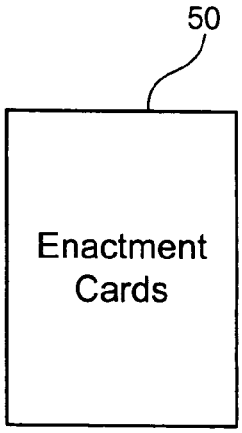
FIG. 2 is a perspective view of a deck of enactment cards of the preferred embodiment of applicants' game apparatus.

The game apparatus includes a deck of enactment cards as set forth in FIG. 2, each card of the deck having a top surface identifying the card as an enactment card, and a bottom surface with information. The information on the bottom surface of the enactment cards describes the situation that calls for improvisation. There are typically 50 cards to the deck, but it will be recognized that any suitable number of cards may be used.

Figure 3:
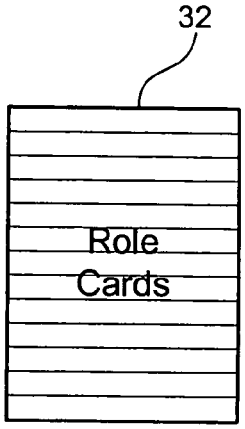
FIG. 3 is a perspective view of a deck of role cards of the preferred embodiment of applicants' game apparatus.

FIG. 3 illustrates a deck of role cards, the deck comprising a plurality of cards, each card having a top surface indicating the title and a bottom surface providing a role for the player to enact the situation described on the drawn enactment card. There are typically 32 cards to the deck, but it will be recognized that any suitable number of cards may be used.

Figure 4:
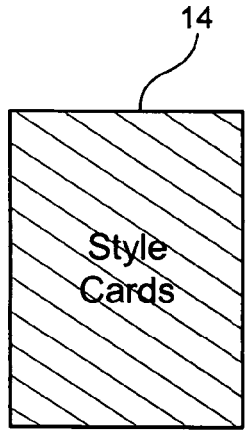
FIG. 4 is a perspective view of a deck of style cards of the preferred embodiment of applicants' game apparatus.

FIG. 4 illustrates a deck of style cards, the deck comprising a plurality of cards, each card having a top surface indicating the title and a bottom surface providing a style for the player to enact the situation described on the drawn enactment card. There are typically 14 cards to the deck, but it will be recognized that any suitable number of cards may be used.

Figure 5:
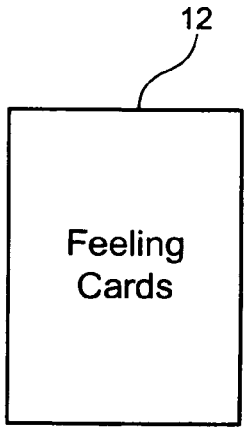
FIG. 5 is a perspective view of a deck of feeling cards of the preferred embodiment of applicants' game apparatus.

FIG. 5 illustrates a deck of feeling cards, the deck comprising a plurality of cards, each card having a top surface indicating the title and a bottom surface providing a feeling for the player to enact the situation described on the drawn enactment card. There are typically 12 cards to the deck, but it will be recognized that any suitable number of cards may be used.

Figure 6:
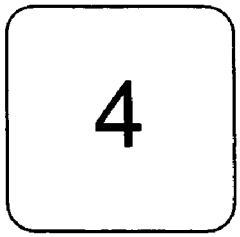
FIG. 6 is a perspective view of a pair of dice of the preferred embodiment of applicants' game apparatus.

FIG. 6 illustrates the dice of the game apparatus. The dice provide a means for randomly selecting the number of spaces or boxes a player (or client) will move in response to the roll of the dice, the movement being the movement of the player (or client) piece (26) around the perimeter boxes (18) of the game board (12) according to the rules as set forth below. It will be recognized that other means for randomly selecting a number, such as a spinner or electronic means, may be used in place of dice.

Figure 7:
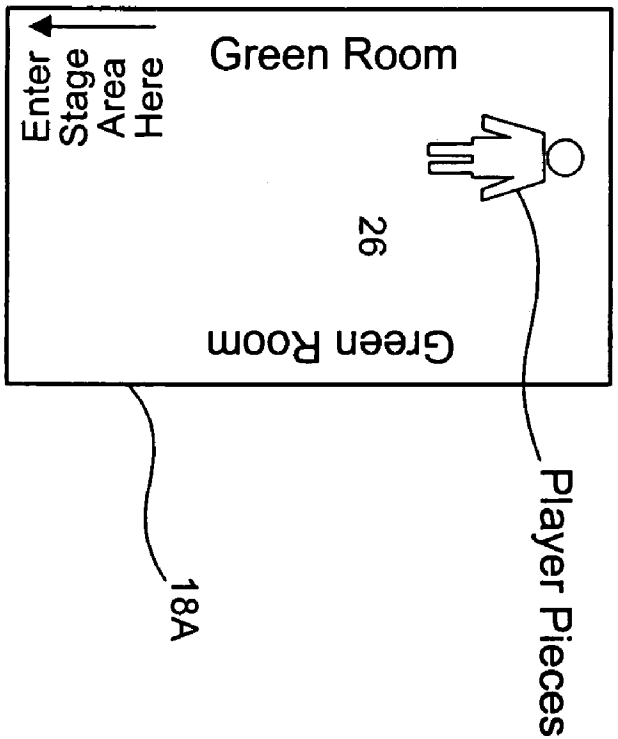
FIG. 7 is a side elevational view of the plurality of player pieces of the preferred embodiment of applicants' game apparatus.

FIG. 7 illustrates player pieces. A player piece (26) may be made of plastic in the shape of a person, for issuance to players for use in moving around the board during the play of the game. The player pieces are typically distinguished by their different colors. There will be a plurality of player pieces, typically from 4 to 6 for issuance to the players of the game. They player pieces may also be distinguished by using varying shapes, e.g., shapes other than that of a person.

Figure 8:
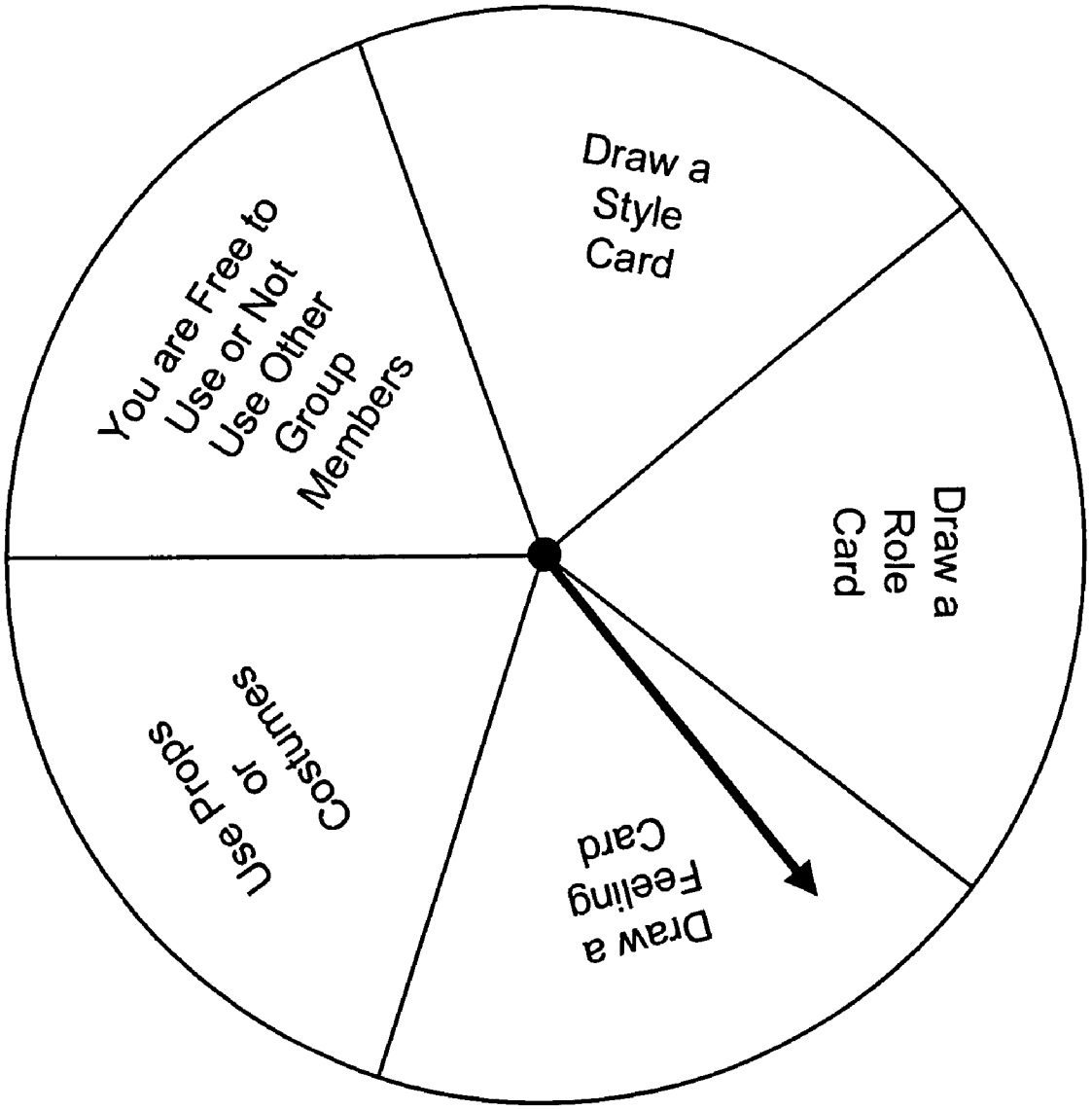
FIG. 8 is a front elevational view of the spinner of the preferred embodiment of applicants' game apparatus.

FIG. 8 illustrates the spinner of the game apparatus, the spinner providing a means for randomly selecting from a number of actions a player will take in response to operating the spinner, the action being either drawing a card from the role, feeling, or style card decks, or using props or costumes in enacting the situation described on the drawn enactment card, or the freedom to use or not use other players in the specified situation. Other means for randomly selecting the action, such as a die or electronic means, may be used in place of the spinner.

Figure 9:
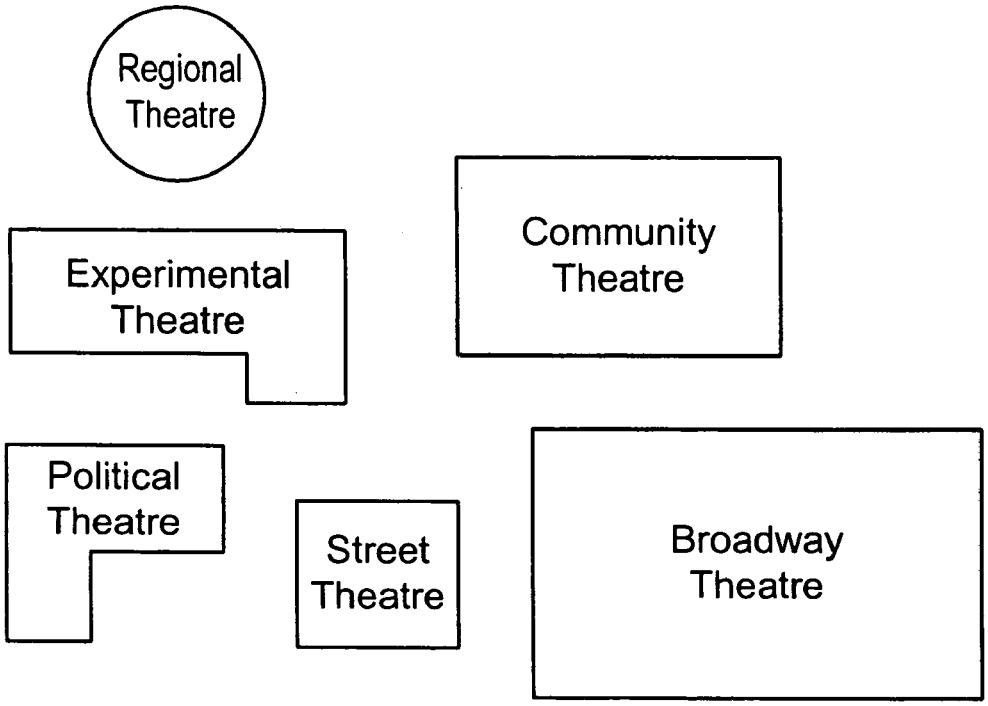
FIG. 9 is a front elevational view of the theater stage pieces of the preferred embodiment of applicants' game apparatus.

FIG. 9 illustrates various theater stage pieces which may be placed on the game board (12). As the players exit the game they are asked to take a final bow on a theater stage of their choice.

Figure 10:
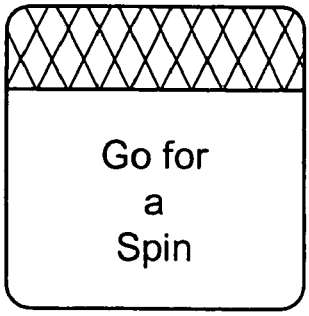
FIG. 10 is a front elevational view of one of the plurality of boxes on the top surface and perimeter of the game board of the preferred embodiment of applicants' game apparatus.

FIG. 10 illustrates an example of one of the perimeter boxes (18) or spaces provided around the perimeter of game board (12). Specifically with reference to FIG. 10, it is seen that each of the boxes have indicia for indicating one of a finite number of colors. Typically there are four colors used, e.g., tan, red, blue, green. Perimeter box 18 may indicate the color typically by having all or a portion of the box that particular color. Each of the perimeter boxes (18) may also have indicia instructing the player's movement through the boxes, instructing the player to draw from one of the role, feeling or style card decks, or instructing the player to spin the spinner for instructions.

RULES OF THE GAME

At the start of the game the order of player (or client) participation is depicted by each player rolling the dice. The player who rolls the highest number will place their playing piece first at the Start position in the Green Room area. If two players roll the same number, then those same two players go for a tie breaker by rolling the dice again to see who rolls the highest number. The players alternate turns by throwing the dice, moving and playing their pieces along the path of squares. The game ends at the Take A Bow square. As players exit the game they are asked to take a final bow on a theater stage of their choice. The path consists of the colors tan, red, blue, and green. If the player lands on any of those particular colors, the player then chooses an enactment card that is of the same color. Each of the 50 enactment cards contains a situation that calls for an improvisation. The player will then improvise the directions on the card. The situations given on the cards are open ended, allowing the player to make choices on the role or roles being invoked. The cards and the pathway are marked and self-explanatory. Players can interpret the cards however they wish.

Included in the path are various marked squares. There are Draw A Role (villain, mother, lawyer etc.), Style (musical comedy, soap opera etc.) and Feeling (love, hate etc) card squares, as well as Go For A Spin squares. For example, if the client lands on a blue square that is also a Style square, the client enacts the situation in the style drawn. The Go For A Spin square corresponds to the spinner. When a player (or client) lands on one of these squares he or she chooses a corresponding card and spins the spinner. This idea was added to give the player an added dimension to the improvisational work and as another tool in the game process.

There are five categories on the spinner: (1) you are free to use or not to use group members; (2) use props or costumes; (3) draw a style card (e.g., musical, soap opera etc.—enactments then are played in the style); (4) draw a feeling card; and, (5) draw a role card. For therapeutic purposes, all categories were added to afford distance, generate role quality and function style choices. With the numbers 3, 4 and 5 there is a possibility of provoking anxiety. Reactions of the participants to these dimensions are helpful and conducive to the game. For purposes of a merely recreational game, these additions make the game more challenging and fun. It is also desired that the various categories will stimulate cohesiveness within the group.

Finally, there are Skip A Space and Go Back 2 Spaces squares on the playing board. These were added to give the game more of a game flavor and are of no psychological significance.

While, in the foregoing, embodiments of the present invention have been set forth in considerable detail for purposes of making a complete disclosure of the invention, it will be apparent to those of skill in the art that numerous changes may be made in such detail without departing from the spirit and principle of the invention.

What is claimed is:

1. A method of playing a game with more than one player, comprising the steps of:

providing a first set of cards, said first set of cards bearing indicia of a situation or role to be enacted; determining an order of play for the number of players;

providing a second set of cards, said second set of cards bearing indicia of a style or feeling to be enacted with the situation or role on said first set of cards.;

each player placing, in order of play, a player piece at a start box on the game board; each player operating a random selection means to obtain a number from a finite set of numbers;

each player moving, in response to the operation of the random selection means, corresponding to the selected number;

each player selecting a first card from said first set of cards;

each player selecting a second card from said second set of cards;

each player enacting a situation or role appearing on said first selected card with the style or feeling described in said second selected card.

2. The method of claim 1, further comprising the steps of:

providing a spinner for selecting from a finite number of actions to be taken by each player including selecting a card from one of said additional sets of cards;

each player operating the spinner;

each player performing, in response to the operation of the spinner.

* * * * *